US010158189B2

(12) United States Patent
Kutsuna et al.

(10) Patent No.: US 10,158,189 B2
(45) Date of Patent: Dec. 18, 2018

(54) CONNECTOR HAVING A HOUSING INSEPARABLY CONNECTING TWO OTHER HOUSINGS

(71) Applicant: YAZAKI CORPORATION, Tokyo (JP)

(72) Inventors: Yoji Kutsuna, Makinohara (JP); Shin Nemoto, Makinohara (JP); Shunsuke Narama, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/965,047

(22) Filed: Apr. 27, 2018

(65) Prior Publication Data

US 2018/0309225 A1 Oct. 25, 2018

Related U.S. Application Data

(63) Continuation of application No. PCT/JP2016/082053, filed on Oct. 28, 2016.

(30) Foreign Application Priority Data

Oct. 28, 2015 (JP) ..... 2015-212275

(51) Int. Cl.

| | |
|---|---|
| ***H01R 13/62*** | (2006.01) |
| ***H01R 13/506*** | (2006.01) |
| ***H01R 43/18*** | (2006.01) |
| ***H01R 13/518*** | (2006.01) |
| ***H01R 13/639*** | (2006.01) |

(52) U.S. Cl.

CPC ..... *H01R 13/506* (2013.01); *H01R 13/518* (2013.01); *H01R 13/639* (2013.01); *H01R 43/18* (2013.01)

(58) Field of Classification Search

CPC ..... H01R 13/502; H01R 13/5045; H01R 13/506; H01R 13/516; H01R 13/518;

(Continued)

(56) References Cited

U.S. PATENT DOCUMENTS 6,322,391 B1 * 11/2001 Kodama ..... H01R 13/4223 439/595
7,470,157 B2 * 12/2008 Hiramatsu ..... H01R 13/4365 439/595

(Continued)

FOREIGN PATENT DOCUMENTS

| | | |
|---|---|---|
| JP | 2008-16261 A | 1/2008 |
| JP | 2013-4431 A | 1/2013 |
| JP | 2015-72868 A | 4/2015 |

OTHER PUBLICATIONS

Int. Search Report dated Jan. 24, 2017 issued by the Int. Searching Authority in corresponding Application No. PCT/JP2016/082053 (PCT/ISA/210).

(Continued)

*Primary Examiner* — Chandrika Prasad

(74) *Attorney, Agent, or Firm* — Sughrue Mion, PLLC

(57) ABSTRACT

A terminal reception chamber (201) of a connector (1) includes a first chamber (201A), a second chamber (201B) and a third chamber (201C). The connector includes a first housing (100) defining a mating terminal insertion hole (102), a second housing (200) defining the first chamber and the second chambers and attached to the first housing, and a third housing (300) defining the third chambers and attached to the first housing and the second housing to contact with the first housing and the second housing and to inseparably connect the first housing and the second housing.

3 Claims, 21 Drawing Sheets

(58) Field of Classification Search
CPC .... H01R 13/201; H01R 13/62; H01R 13/639; H01R 13/4361; H01R 43/18
USPC ..... 439/625, 367, 368, 153, 155, 157, 347, 439/352
See application file for complete search history.

(56) References Cited

U.S. PATENT DOCUMENTS

| | | | | |
|---|---|---|---|---|
| 8,721,375 | B2 * | 5/2014 | Hori | H01R 13/4362 439/752 |
| 9,385,460 | B2 * | 7/2016 | Shinohara | H01R 13/4223 |
| 9,472,884 | B2 * | 10/2016 | Kutsuna | H01R 13/4362 |
| 2002/0197915 | A1 * | 12/2002 | Mase | H01R 13/4362 439/752 |
| 2008/0009201 | A1 | 1/2008 | Hiramatsu | |
| 2012/0328359 | A1 | 12/2012 | Hori | |
| 2015/0099404 | A1 | 4/2015 | Lida | |
| 2015/0295354 | A1 * | 10/2015 | Morello | H01R 13/639 439/352 |

OTHER PUBLICATIONS

Written Opinion dated Jan. 24, 2017 issued by the Int. Searching Authority in corresponding Application No. PCT/JP2016/082053 (PCT/ISA/237).
Translation of Written Opinion PCT/ISA/237 previously disclosed and submitted with an IDS filed Apr. 27, 2018.

* cited by examiner

CONNECTOR HAVING A HOUSING INSEPARABLY CONNECTING TWO OTHER HOUSINGS

CROSS-REFERENCES TO RELATED APPLICATION(S)

This application is a continuation application of International Application No. PCT/JP2016/082053 filed on Oct. 28, 2016, which claims priority from Japanese Patent Application No. 2015-212275 filed on Oct. 28, 2015, and the entire contents of these applications are incorporated herein by reference.

This application is based on and claims priority from Japanese Patent Application No. 2015-212275 filed on Oct. 28, 2015, and the entire contents of which are incorporated herein by reference.

BACKGROUND

The present invention relates to a connector including a terminal reception chamber which can receive a terminal of an electric wire end, and a mating terminal insertion hole which can guide a mating terminal into the terminal reception chamber.

Background Art

A connector having a combination of a plurality of independent members has been heretofore proposed. For example, one of conventional connectors (hereinafter referred to as "conventional connector") is formed by a combination of two members, that is, a housing defining a terminal reception chamber, and a front retainer defining an insertion hole for guiding a mating terminal into the terminal reception chamber. Those two members can be assembled to each other when a convex portion at a front end of a lock arm belonging to the front retainer is engaged with a concave portion belonging to a lock receiving portion of the housing (for example, see Patent Literature 1).

As for details of the above connection structure, refer to JP 2008-16261 A.

SUMMARY

When a connector is formed by a combination of a plurality of members, it is desired to combine the members as firmly as possible in order to prevent the members from unintentionally separating from each other. For example, a manner of expanding an engaging margin of the lock arm and the lock receiving portion, and a manner of improving rigidity of the lock arm are conceivable in order to assemble the two members constituting the conventional connector firmly to each other.

However, the former manner may cause increase in size of the lock arm and the lock receiving portion (and hence increase in size of the connector), and the latter manner may cause difficulty in the assembling work of the two members (and hence reduction in manufacturing efficiency of the connector).

An object of the present invention is to provide a connector capable of achieving both miniaturization of the connector and easiness in manufacturing the connector while assembling a plurality of members to one another as firmly as possible.

Embodiments of the present invention provide the following items (1) to (3).

(1)

A connector comprising: a terminal reception chamber; and a mating terminal insertion hole to guide a mating terminal into the terminal reception chamber, the terminal reception chamber having:

a first chamber including an opening on a front side of the terminal reception chamber;

a second chamber including an opening on a back side of the terminal reception chamber; and a third chamber placed between the first chamber and the second chamber;

the connector further comprising:

a first housing defining the mating terminal insertion hole;

a second housing defining the first chamber and the second chamber and being attached to the first housing: and a third housing defining the third chamber and being attached to the first housing and the second housing to contact with both of the first housing and the second housing and to inseparably connect the first housing and the second housing.

(2)

The connector according to item (1), wherein the second housing has a connection portion connecting a part defining the first chamber and a part defining the second chamber to eliminate a relative movement between the first chamber and the second chamber.

(3)

The connector according to item 1 or item 2, wherein the third housing has a protrusion portion protruding toward the second housing; and the protrusion portion contacts with an outer wall surface of the second housing upon the third housing being located in a temporary mounting position where an axis line of the terminal reception chamber has a linear shape, while the protrusion portion fits to the second housing upon the third housing being located in a final mounting position where the axis line of the terminal reception chamber has a curved shape.

According to first aspect of the invention, relating to the item (1), the third housing defining a central portion (third chamber) of the terminal reception chamber is attached to the second housing defining opposite end portions (first and second chambers) of the terminal reception chamber (for example, the third housing is inserted into the second housing so that the third chamber is placed between the first chamber and the second chamber). The third housing is also attached to the first housing defining the mating terminal insertion hole. To say other words, the third housing serves as a connection tool (bolt) connecting the first housing and the second housing with each other. That is, separation (relative movement) between the first housing and the second housing is prevented by the third housing (bolt).

In such an assembling structure (bolting), the relevancy between the size of the assembling structure (third housing) and the rigidity of the assembling is lower than in the assembling structure (engagement between the convex portion and the concave portion) of the conventional connector. In the same manner, the relevancy between the magnitude of force required for the assembling work (the force with which the third housing is mounted) and the rigidity of the assembling is also lower. Accordingly, a plurality of members (first to third housings) can be assembled to one another firmly without increasing the size of the third housing. Further, the members can be assembled firmly without increasing the force with which the third housing is mounted.

Therefore, in the connector according to the configuration, it is possible to achieve both the miniaturization of the connector and the easiness in manufacturing the connector while assembling the plurality of members as firmly as possible.

In the connector according to the configuration, the positional relationship among the first to third housings is not limited particularly. For example, when the first housing and the second housing are attached to each other, the second housing may be inserted into the first housing. On the contrary, the first housing may be inserted into the second housing. In addition, for example, when the third housing is attached, the third housing may be inserted into the second housing from the vertical direction of the second housing, or may be inserted into the second housing from the lateral direction of the second housing.

Further, the expression that the second housing defines the first chamber and the second chamber does not mean only that the second housing defines the first chamber and the second chamber entirely, but also means that the second housing defines parts of the first chamber and the second chamber (and another housing defines the other parts of the first chamber and the second chamber). The same thing can be applied to the expression that the third housing defines the third chamber.

According to second aspect of the invention, relating to the item (2), the part defining the first chamber and the part defining second chamber are connected to each other. Accordingly, in such a case that the third housing is attached to the second housing (the third chamber is inserted between the first chamber and the second chamber), axial misalignment (in which the axis of the terminal reception chamber is not linear) hardly occurs in the terminal reception chamber, as compared with a case where those parts are separated from each other. It is therefore possible to prevent the situation that a terminal cannot be attached (inserted) due to the axial misalignment of the terminal reception chamber. To say other words, the connector according to the configuration is excellent in terminal insertion.

According to third aspect of the invention, relating to the item (3), the protrusion portion abuts against the second housing when the third housing which is being attached to the second housing is located in the temporary mounting position. Accordingly, the third housing is prevented from unintentionally moving to the final mounting position. Further, when the third housing moves from the temporary mounting position to the final mounting position, the protrusion portion is fitted to the second housing. As a result, a feeling of moderation (click feeling) can be obtained as soon as the second housing is attached to the third housing.

Advantage of the Invention

According to the present invention, it is possible to achieve both miniaturization of a connector and easiness in manufacturing the connector while assembling a plurality of members constituting the connector to one another as firmly as possible.

Several aspects of the invention have been described briefly above. The further details of the invention will be made clearer if the following description is read through with reference to the accompanying drawings.

DETAILED DESCRIPTION

First Embodiment

A connector (hereinafter referred to as "connector 1") according to a first embodiment of the invention will be described below with reference to FIGS. 1 to 18.

Figure 1:
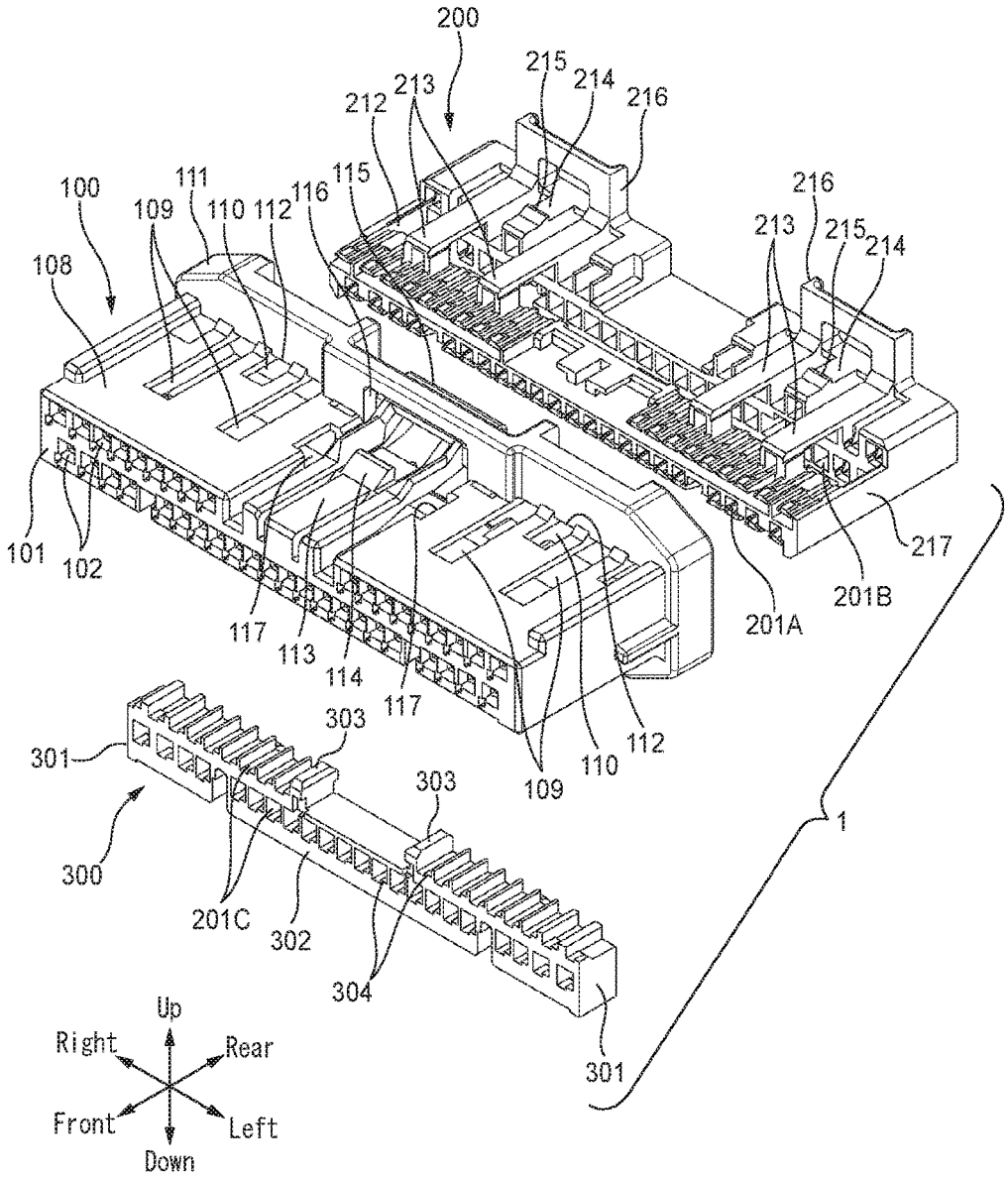
FIG. 1 is an exploded perspective view showing a configuration of a connector according to a first embodiment of the invention.

In FIG. 1, the direction in which the connector 1 faces a mating connector (not shown) is referred to as a front direction (front side), the direction opposite to the front direction is referred to as a rear direction (back side), the width direction of the connector 1 perpendicular to the front/rear direction is referred to as a left/right direction, and the height direction of the connector 1 perpendicular to the front/rear direction is referred to as an up/down direction. The same thing can be applied to FIGS. 2 to 18.

(Overall Structure of Connector)

As shown in FIG. 1, the connector 1 has an outer housing (first housing) 100, an inner housing (second housing) 200, and a spacer (third housing) 300. The outer housing 100 forms an external surface of the connector 1, and has a function of fitting the connector 1 to a mating connector, etc. The inner housing 200 forms an internal structure of the connector 1, and has a function (primary lock) of retaining terminals of an electric wire end, etc. The spacer 300 has a function (secondary lock) of preventing the terminals retained by the inner housing 200 from coming off, a function of connecting the outer housing 100 and the inner housing inseparably from each other, etc. Generally the spacer 300 may be also referred to as a retainer.

(Outer Housing)

Figure 2:
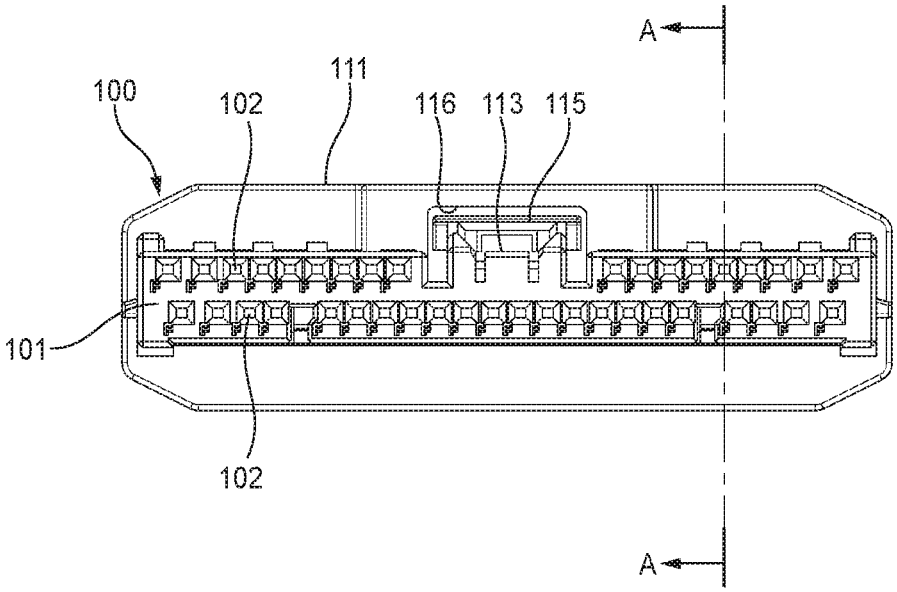
FIG. 2 is a front view of an outer housing constituting the connector in FIG. 1.

As shown in FIG. 2, in the outer housing 100, a plurality of mating terminal insertion holes 102 to which terminals (mating terminals) of a mating connector can be inserted are defined in a front wall 101 which is a laterally long rectangle when the outer housing 100 is viewed from the front direction (front side). The mating terminal insertion holes 102 are designed to guide front ends of the terminals of the mating connector toward terminal reception chambers 201 when the connector 1 is fitted to the mating connector (not shown).

Figure 3B:
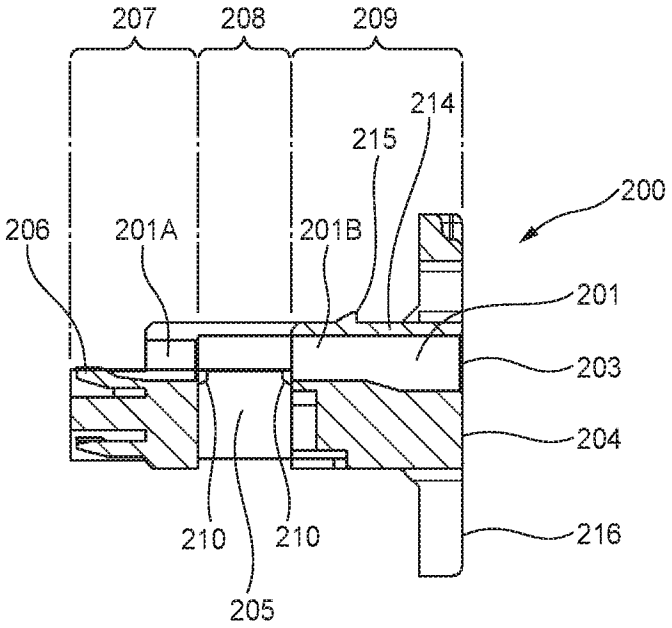
FIG. 3B is a sectional view of an inner housing taken on line A-A in FIG. 2
Figure 3A:
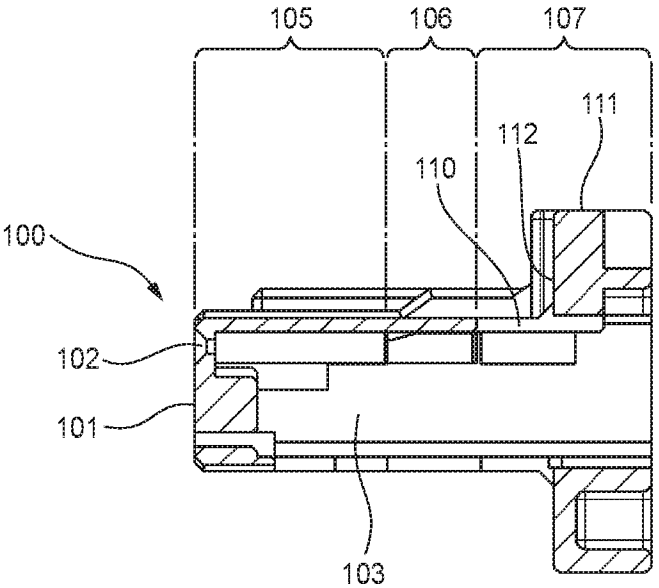
FIG. 3A is a sectional view of the outer housing taken on line A-A in FIG. 2.

As shown in FIG. 3A, a cavity 103 which is a space for receiving the inner housing 200 is provided inside the outer housing 100. A rear end of the cavity 103 is open to a rear end surface of the outer housing 100 so that the inner housing 200 can be inserted into the outer housing 100 from the rear direction toward the front direction. A lower surface of an intermediate portion of the cavity 103 in the front/rear direction is open downward. Guide grooves 104 (see FIG. 18) for guiding the spacer 300 to be inserted into the cavity 103 from the down direction toward the up direction is provided in opposite wall surfaces of the cavity 103 in the left/right direction as will be described later. Further, a part for regulating the position of the spacer 300 may be also provided in an upper wall surface of the cavity 103 if necessary. The guide grooves 104 etc. are designed to regulate the front/rear-direction position of the spacer 300 inserted into the cavity 103.

The cavity 103 has a front portion reception portion 105, an intermediate portion reception portion 106 and a rear portion reception portion 107 in order from the front direction toward the rear direction. The front portion reception portion 105, the intermediate portion reception portion 106 and the rear portion reception portion 107 correspond to a front portion 207, an intermediate portion 208 and a rear portion 209 of the inner housing 200 respectively, as will be described later.

See FIG. 1 again. In an upper wall 108 of the outer housing 100, fitting guide grooves 109 serving as guides for fitting the inner housing 200 to the outer housing 100 and lock guide grooves 110 serving as guides for locking the inner housing 200 are provided to extend in the front/rear direction. A rear end of each lock guide groove 110 extends to a back flange 111, and a boundary wall of the back flange 111 to the lock guide groove 110 serves as a lock wall 112 for locking a lock protrusion 215 of the inner housing 200 as will be described later.

In a center portion of the upper wall 108 of the outer housing 100 in the left/right direction, a lock arm 113 is provided for locking the connector 1 to a mating connector (not shown) when the connector 1 is fitted to the mating connector. A lock protrusion 114 is provided on an upper surface of the lock arm 113. An unlock arm 115 for unlocking the lock state of the lock arm 113 is provided around the lock arm 113. In the back flange 111, a notch portion 116 is provided for preventing interference of the back flange 111 with the lock arm 113 and the unlock arm 115. Reception holes 117 which allow entrance of temporary lock convex portions 303 of the spacer 300 are provided in the left/right-direction neighborhood of the unlock arm 115.

(Inner Housing)

As shown in FIG. 1, the inner housing 200 is shaped so that a main portion of the inner housing 200 can be received in the cavity 103 of the outer housing 100.

As shown in FIG. 3B, the inner housing 200 defines first chambers 201A including openings 202 (see FIG. 7) in the front direction (front side) of the terminal reception chamber 201, and second chambers 201B including openings 203 in the rear direction (back side) of the terminal reception chamber 201. Specifically, the rear ends of the terminal reception chambers 201 are open (openings 203) to a rear wall (back wall) 204 of the inner housing 200. As shown in FIG. 1, the terminal reception chambers 201 in the lower stage are formed as through holes each having a peripheral wall in its whole circumference, while the terminal reception chambers 201 in the upper stage are formed into concave grooves each having a peripheral wall whose upper half has been omitted.

In the inner housing 200, as shown in FIG. 3B, a spacer insertion hole 205 to which the spacer 300 can be inserted is provided between the first chambers 201A and the second chambers 201B as will be described later. A flexible lance 206 for primarily locking a terminal (not shown) of an electric wire end is provided in a bottom wall of the first chamber 201A of each terminal reception chamber 201.

The front portion 207, the intermediate portion 208 and the rear portion 209 in the inner housing 200 correspond to the front portion reception portion 105, the intermediate portion reception portion 106 and the rear portion reception portion 107 of the cavity 103 in the outer housing 100 respectively.

Figure 18:
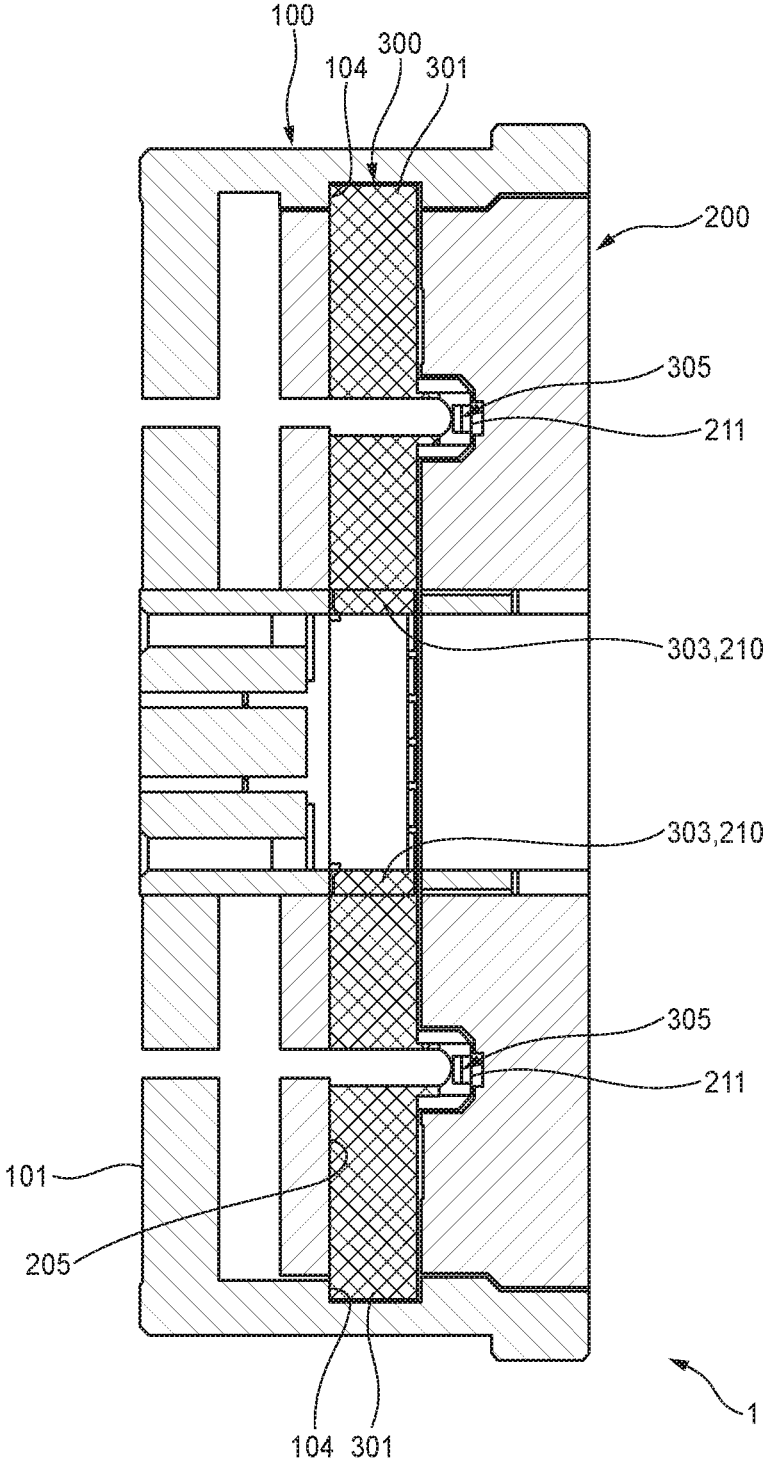
FIG. 18 a sectional view taken on line E-E in FIG. 15.

The spacer insertion hole 205 is formed as an opening having a rectangular shape in planar view so that the spacer 300 can be inserted into the inner housing 200 from the down direction toward the up direction. On front and rear walls opposed to each other near the upper end of the spacer insertion hole 205, spacer temporary lock protrusions 210 are provided to protrude toward the inside of the spacer insertion hole 205. As shown in FIG. 18, a spacer final lock portion 211 is provided in the rear wall of the spacer insertion hole 205.

See FIG. 1 again. Fitting guide convex portions 213 and lock guide convex portions 214 are provided on an upper wall 212 of the inner housing 200. The fitting guide convex portions 213 are guided by the fitting guide grooves 109 of the outer housing 100. The lock guide convex portions 214 are guided by the lock guide grooves 110 of the outer housing 100. On an upper surface of each lock guide convex portion 214, a lock protrusion 215 is provided so that the lock protrusion 215 can be locked to the lock wall 112 of the outer housing 100 when the inner housing 200 has been assembled to the outer housing 100 (upon finishing the assembling). A rear end of each fitting guide convex portion 213 is connected to a back flange 216.

The inner housing 200 has two regions, that is, the front portion 207 and the rear portion 209, which sandwich the spacer insertion hole 205 (intermediate portion 208). However, the two regions, that is, the front portion 207 and the rear portion 209 (or the first chambers 201A and the second chambers 201B) are connected through connection portions 217 and the fitting guide convex portions 213 on the left/right-direction opposite ends of the inner housing 200 so that the two regions cannot move relatively to each other.

(Spacer)

As shown in FIG. 1, the spacer 300 is shaped to be inserted into the spacer insertion hole 205 and so on of the inner housing 200 from the down direction to the up direction of the outer housing 100 and the inner housing 200 so as to cross the axes of the terminal reception chambers 201.

More specifically, the spacer 300 is inserted into the spacer insertion hole 205 of the inner housing 200 in a state where opposite end portions 301 in the left/right direction have been engaged with the guide grooves 104 (also see FIG. 18) of the outer housing 100. As a result, the spacer 300 is received to be placed between the first chambers 201A and the second chambers 201B of the inner housing 200 (also see FIG. 13).

A body 302 of the spacer 300 has a rectangular parallelepiped block-like shape. Along the front/rear direction of the body 302, the spacer 300 defines third chambers 201C placed between the first chambers 201A and the second chambers 201B. The third chambers 201C in the lower stage are formed as through holes each having a peripheral wall in its whole circumference, while the third chambers 201C in the upper stage are formed into concave grooves each having a peripheral wall whose upper half has been omitted. A lower wall part of each third chamber 201C serves as a terminal coming-off preventing wall portion 304 (see FIG. 17) for preventing (secondary lock) a terminal received in the corresponding terminal reception chamber 201 from coming off.

A pair of left and right temporary lock convex portions 303 are provided to protrude on the upper surface of the body 302 of the spacer 300. The temporary lock convex portions 303 are designed to be engaged with the spacer temporary lock protrusions 210 provided on the front and rear walls of the spacer insertion hole 205 as soon as the spacer 300 is inserted into the spacer insertion hole 205 of the inner housing 200 to reach the temporary lock position.

On the rear surface of the body 302 of the spacer 300, a pair of left and right final lock portions 305 are provided to protrude. The final lock portions 305 are parts which will be engaged with the spacer final lock portions 211 provided in the inner housing 200 as soon as the spacer 300 is inserted into the spacer insertion hole 205 of the inner housing 200 to reach the final lock position.

(Summary of Connector Structure)

As has been described above, the connector 1 is formed in such a manner that the inner housing 200 is received inside the outer housing 100, and the spacer 300 is then inserted into the spacer insertion hole 205 of the inner housing 200. On this occasion, the terminal reception chambers 201 are defined out of the first chambers 201A and the second chambers 201B defined by the inner housing 200, and the third chambers 201C defined by the spacer 300.

(Assembling Procedure of Connector)

Figure 4:
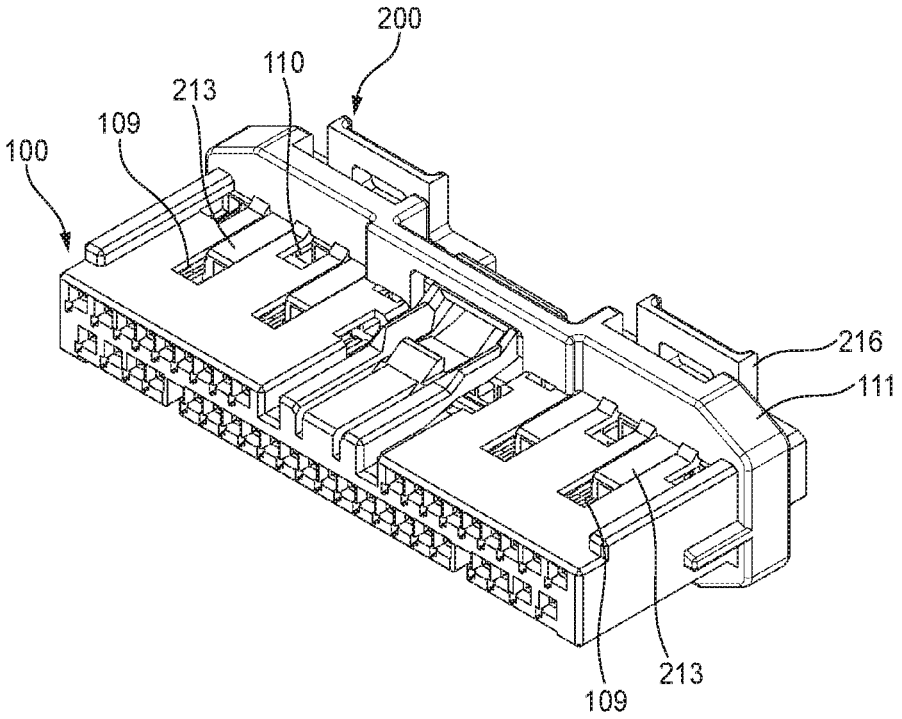
FIG. 4 is a perspective view showing a state where the inner housing is being assembled to the outer inner housing.
Figure 5:
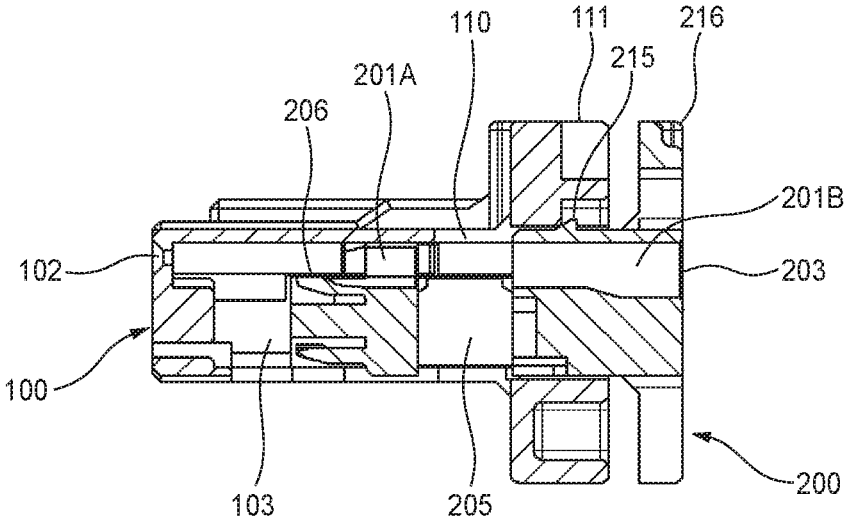
FIG. 5 is a sectional view taken on line A-A in FIG. 2, showing the state shown in FIG. 4 (on the way of assembling).

First, as shown in FIG. 4 and FIG. 5, the inner housing 200 is inserted into the outer housing 100 from the rear direction. Thus, the fitting guide convex portions 213 of the inner housing 200 are guided by the fitting guide grooves 109 of the outer housing 100. In the same manner, the lock guide convex portions 214 of the inner housing 200 are guided by the lock guide grooves 110 of the outer housing 100.

Figure 6:
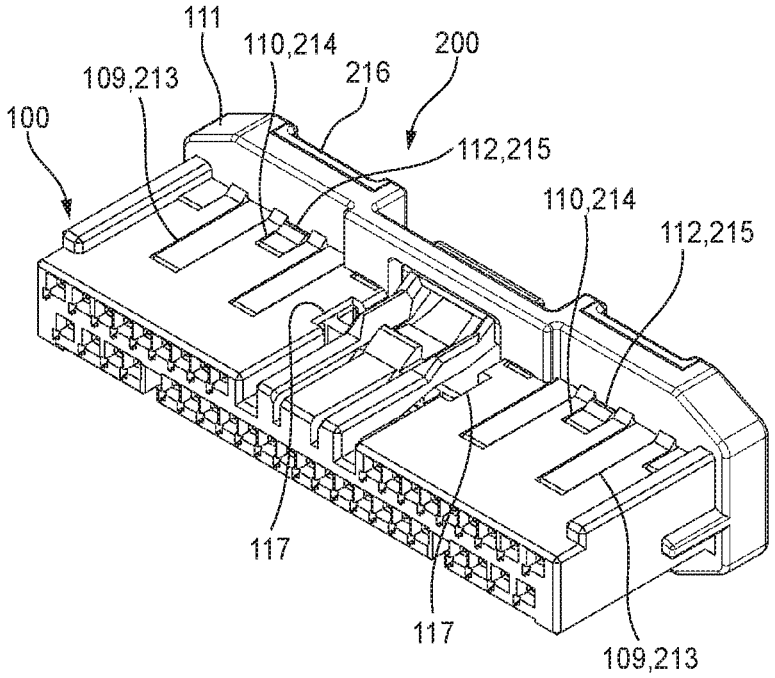
FIG. 6 is a perspective view showing a state where the inner housing has been assembled to the outer housing.
Figure 7:
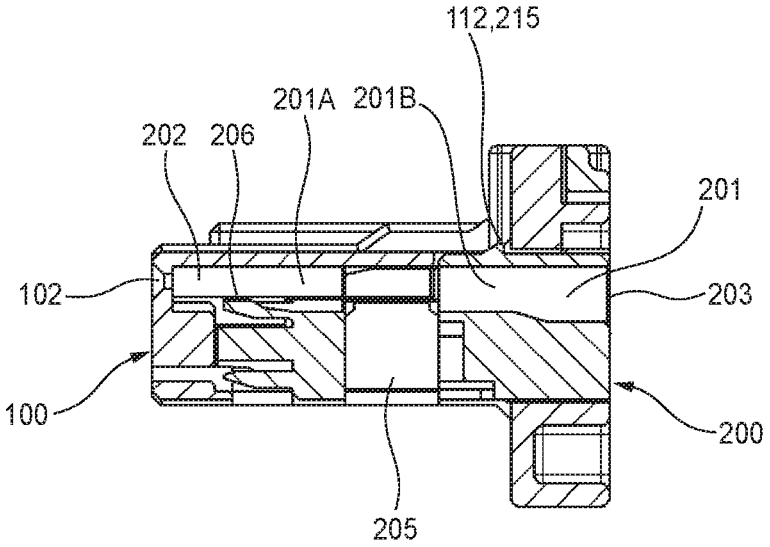
FIG. 7 is a sectional view taken on line A-A in FIG. 2, showing the state shown in FIG. 6 (upon finishing the assembling).
Figure 8:
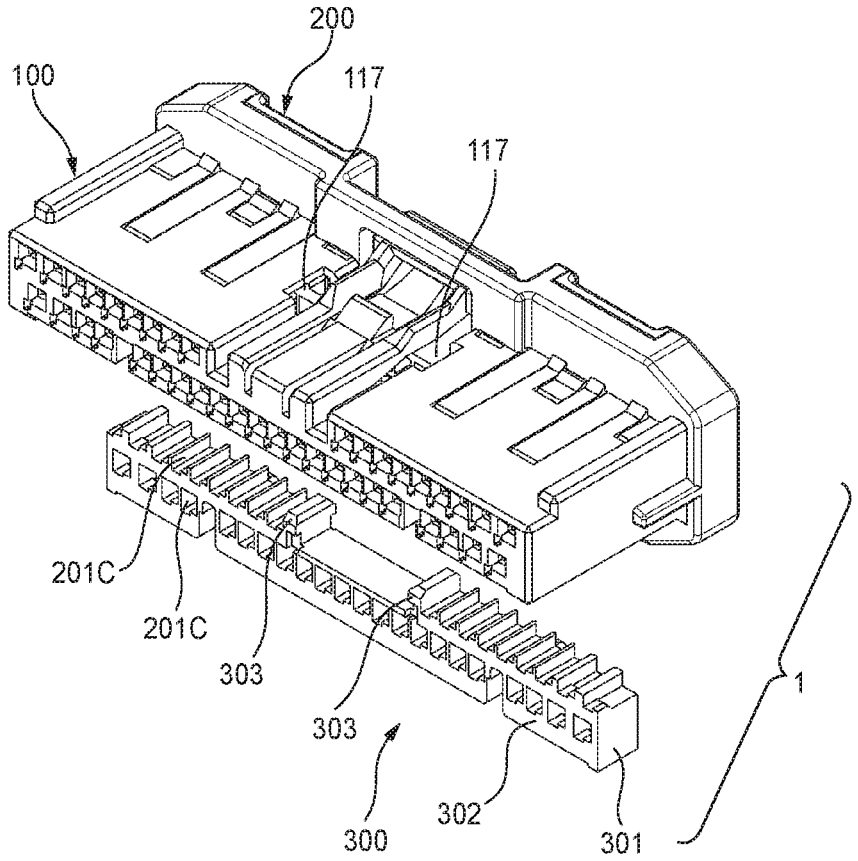
FIG. 8 is a perspective view showing a state where a spacer has not yet been assembled to an assembly of the outer housing and the inner housing shown in FIG. 6.
Figure 9:
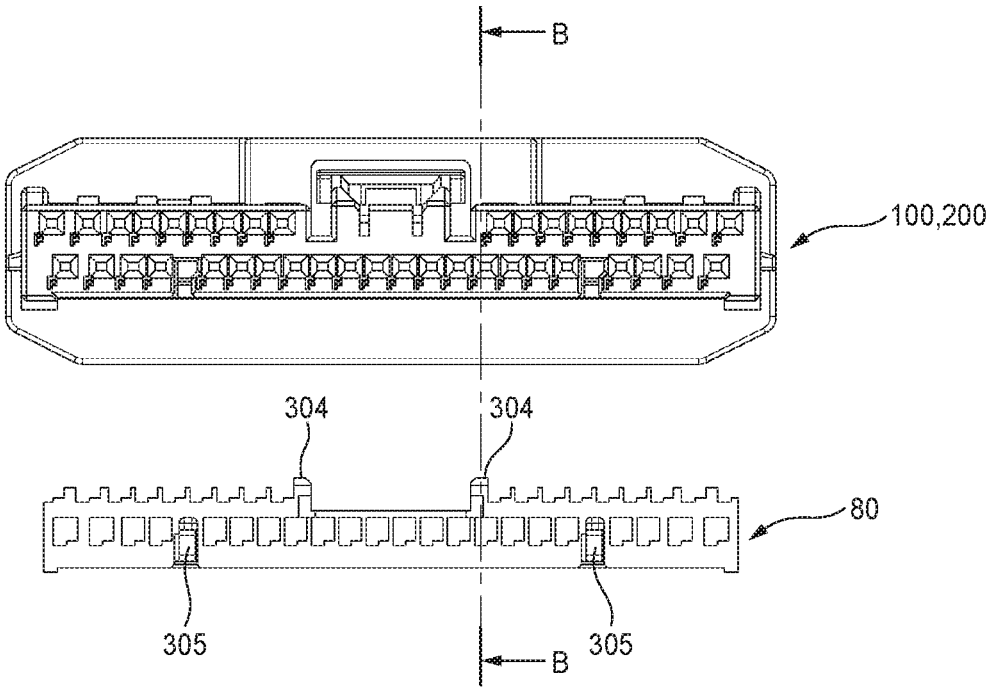
FIG. 9 is a front view of the outer housing and the spacer in the state shown in FIG. 8.
Figure 10:
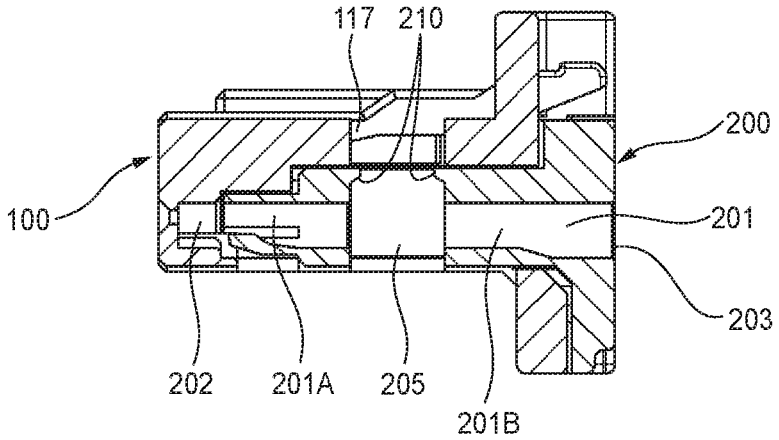
FIG. 10 is a sectional view of the outer housing, the inner housing and the spacer taken on line B-B in FIG. 9.
Figure 10:
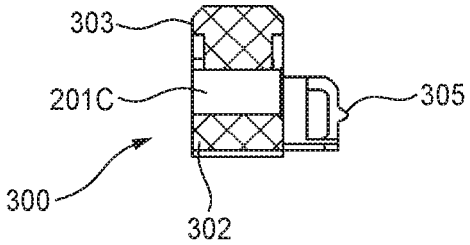
Figure 11:
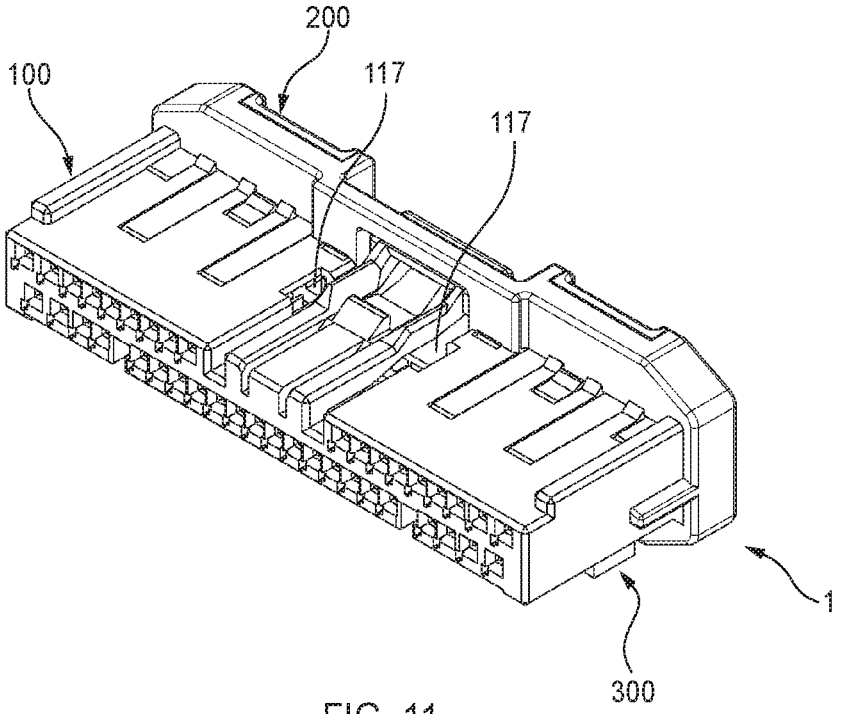
FIG. 11 is a perspective view showing a state where the spacer is being assembled to the assembly of the outer housing and the inner housing.
Figure 12:
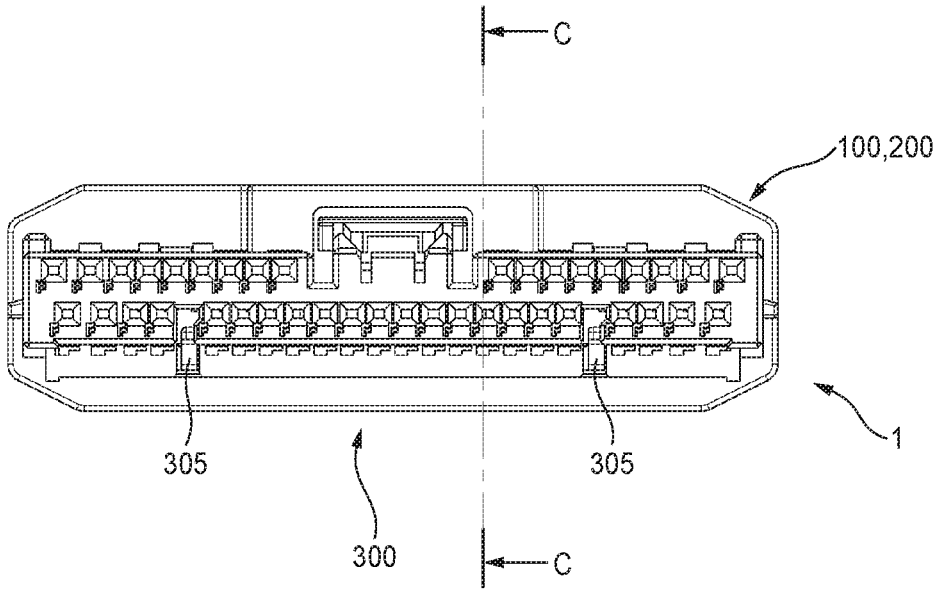
FIG. 12 is a front view of the outer housing and the spacer in the same state as in FIG. 11.
Figure 13:
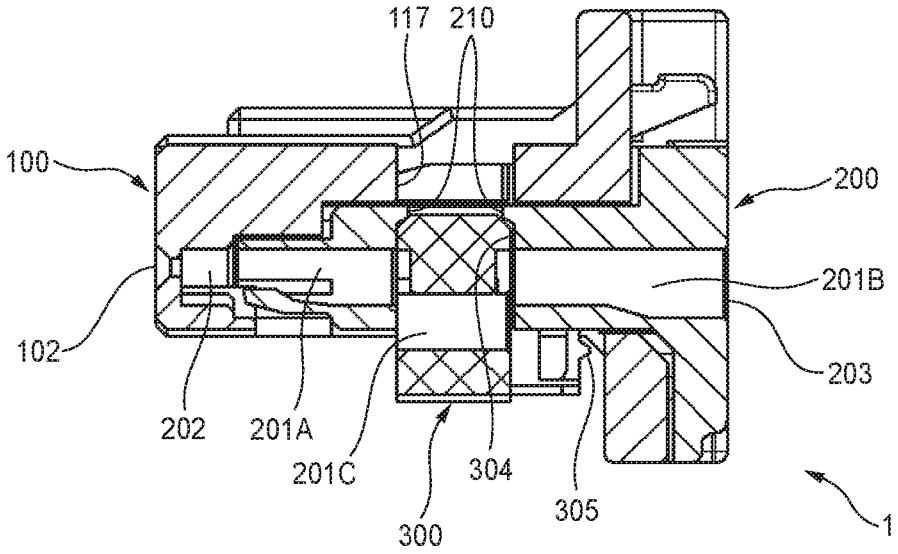
FIG. 13 is a sectional view taken on line C-C in FIG. 12.

Next, as shown in FIG. 6 and FIG. 7, when the inner housing 200 is completely inserted into the outer housing 100, the lock protrusions 215 of the lock guide convex portions 214 of the inner housing 200 are engaged with the lock walls 112 of the lock guide grooves 110 of the outer housing 100 so that the inner housing 200 and the outer housing 100 are locked to each other. However, the lock in this state is achieved only by the engagement between the lock protrusions 215 and the lock walls 112. Therefore, the outer housing 100 and the inner housing 200 are not assembled to each other so firmly. When the inner housing 200 and the outer housing 100 have been completely assembled in this manner, the mating terminal insertion holes 102 of the outer housing 100 and the first chambers 201A of the terminal reception chambers 201 (the front openings 202 of the terminal reception chambers 201) of the inner housing 200 communicate with each other without axial misalignment.

Figure 14:
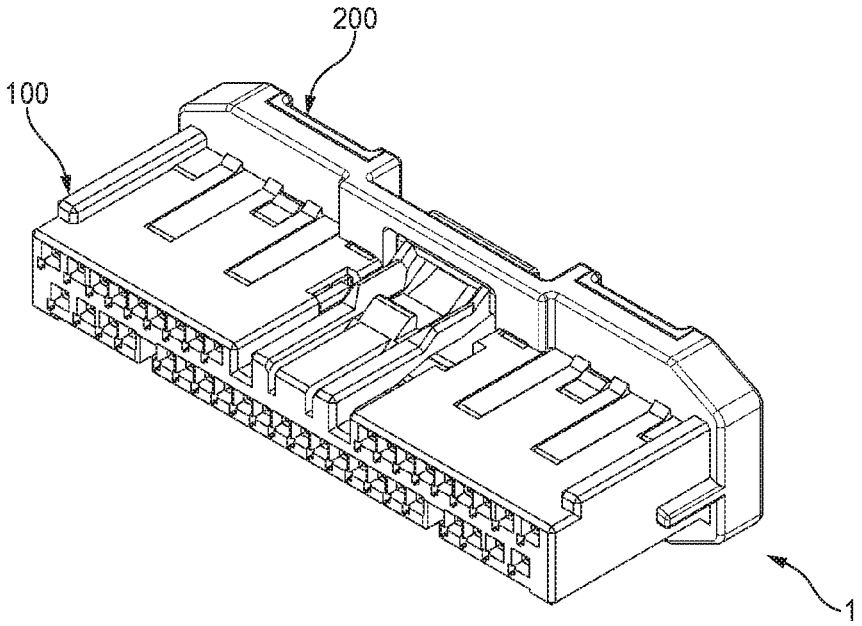
FIG. 14 is a perspective view showing a state where the spacer has been inserted to a temporary lock position in the assembly of the outer housing and the inner housing.
Figure 15:
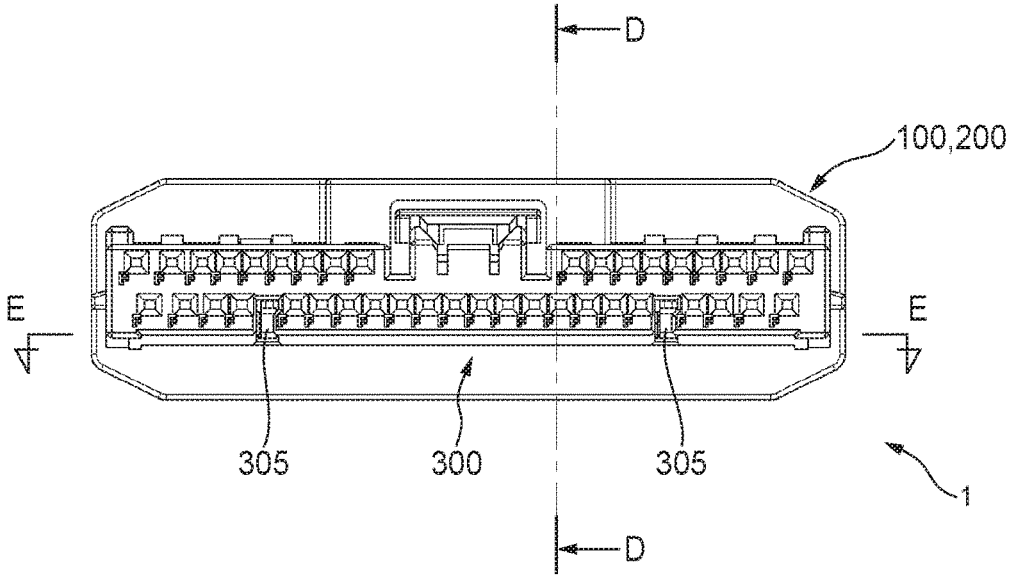
FIG. 15 is a front view of the outer housing in the same state as in FIG. 14.
Figure 16:
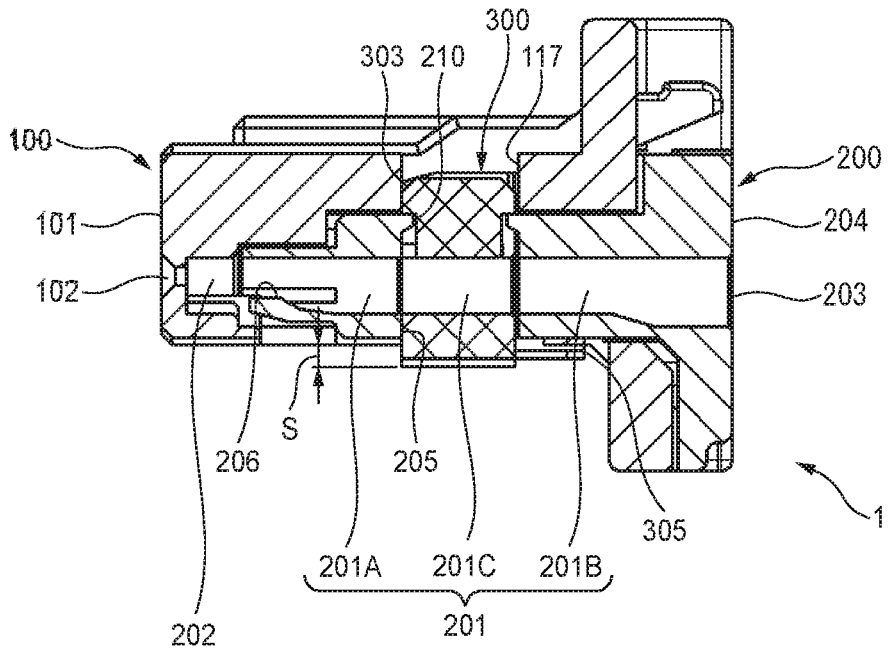
FIG. 16 is a sectional view taken on line D-D in FIG. 15.

Next, as shown in FIGS. 8 to 13, the spacer 300 is inserted into the assembly of the outer housing 100 and the inner housing 200. The spacer 300 is inserted into the spacer insertion hole 205 of the inner housing 200 from the down direction toward the up direction. As soon as the spacer 300 is inserted to the temporary lock position, the temporary lock convex portions 303 of the spacer 300 get over the spacer temporary lock protrusions 210 of the inner housing 200 to establish a temporary lock state as shown in FIGS. 14 to 16. On this occasion, the temporary lock convex portions 303 of the spacer 300 are received by the reception holes 117 of the outer housing 100, and regulated from moving in the front/rear direction by the front and rear walls of the reception holes 117.

In the state where the spacer 300 has been temporarily locked, the first chambers 201A and the second chambers 201B of the terminal reception chambers 201 of the inner housing 200 are aligned through the third chambers 201C of the spacer 300 without axial misalignment (to make the axes of the terminal reception chambers 201 linear) as shown in FIG. 16. That is, the terminal reception chambers 201 of the connector 1 are formed out of the first chambers 201A and the second chambers 201B of the inner housing 200 and the third chambers 201C of the spacer 300. The front openings 202 of the terminal reception chambers 201 (first chambers 201A) are brought into communication with the mating terminal insertion holes 102 of the outer housing 100.

Next, in the state where the spacer 300 has been temporarily locked, terminals (not shown) of a mating terminal end are inserted into the terminal reception chambers 201 of the connector 1 from the rear direction toward the front direction. The terminals are fixed (primarily locked) by the lances 206.

Figure 17:
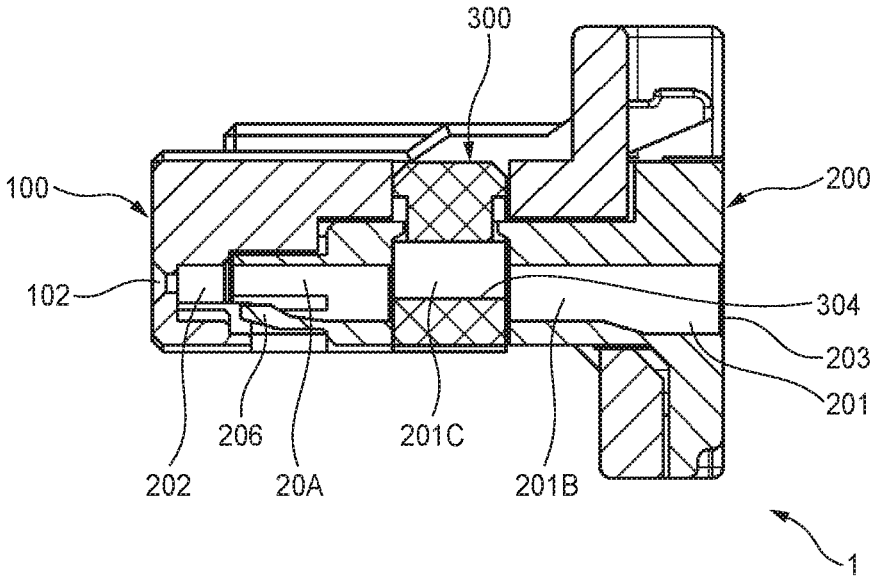
FIG. 17 is a sectional view taken on line D-D in FIG. 15 in a state where the spacer has been inserted to a final lock position.

Next, as shown in FIG. 17, the spacer 300 is further inserted to the final lock position. To say other words, the spacer 300 is pushed upward further in accordance with a protruding dimension S shown in FIG. 16. As a result, the final lock portions 305 (see FIG. 10) provided on the rear surface of the spacer 300 are locked to the spacer final lock portions 211 (see FIG. 18) of the inner housing 200. When the spacer 300 is finally locked, the third chambers 201C of the spacer 300 are offset with respect to the first chambers 201A and the second chambers 201B of the inner housing 200 so that the bottom walls (terminal coming-off preventing wall portions 304) of the third chambers 201C regulate the terminals from moving in the rear direction. Thus, the terminals are surely prevented (secondarily locked) from coming off. Incidentally, when the spacer 300 is in the final lock position, each terminal reception chamber 201 has a curved axis.

When the spacer 300 is further inserted into the assembly of the outer housing 100 and the inner housing 200, the opposite end portions 301 of the spacer 300 are engaged with the guide grooves 104 of the outer housing 100 to surely regulate the outer housing 100 and the inner housing 200 from moving relatively to each other in the front/rear direction, as shown in FIG. 18. To say other words, the spacer 300 serves as a connection tool (bolt) connecting the outer housing 100 and the inner housing 200 to each other. Thus, the inner housing 200 is surely and firmly connected to the outer housing 100 inseparably therefrom.

As has been described above, in the connector 1 according to the embodiment, the outer housing (first housing) 100 and the inner housing (second housing) 200 are connected to each other by the spacer (third housing) 300 like a bolt. Accordingly, the outer housing 100 and the inner housing 200 can be firmly assembled to each other without increasing the size of the spacer 300, as compared with an assembling structure (a lock structure using a lock arm) in a conventional connector. Further, the outer housing 100, the inner housing 200 and the spacer 300 can be firmly assembled to one another without increasing the force with which the spacer 300 is inserted. That is, the connector 1 can achieve both the miniaturization of the connector 1 itself and the easiness in manufacturing the connector 1 while firmly assembling the outer housing 100, the inner housing 200 and the spacer 300.

Furthermore, of each terminal reception chamber 201, the part (front portion 207) defining the first chamber 201A and the part (rear portion 209) defining the second chamber 201B are connected to each other through the connection portion 217. Accordingly, axial misalignment hardly occurs in the terminal reception chamber 201, as compared with the case where the front portion 207 and the rear portion 209 are separated from each other. Accordingly, it is possible to prevent the situation that a terminal cannot be attached (inserted) due to the axial misalignment of the terminal reception chamber 201 (because the terminal reception chamber 201 does not have a linear axis). To say other words, the connector according to the configuration is excellent in terminal insertion.

Second Embodiment

Figure 20:
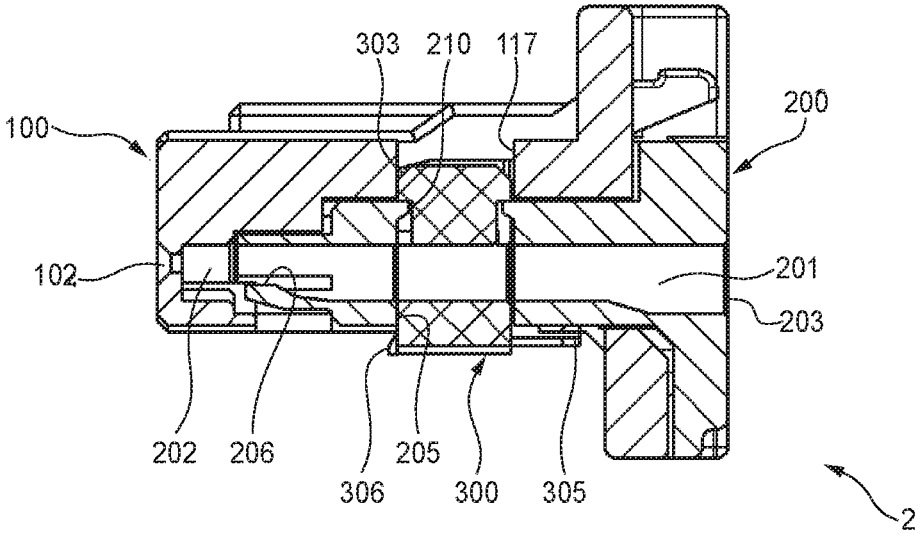
FIG. 20 is a sectional view taken on line D-D in FIG. 15, showing a state where a spacer has been inserted to a temporary position in an assembly of an outer housing and an inner housing shown in FIG. 19.
Figure 21:
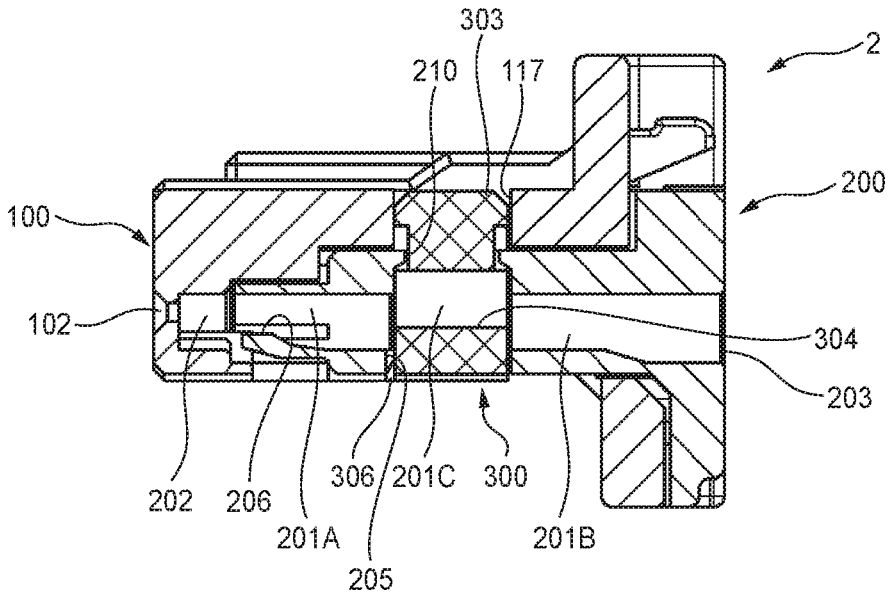
FIG. 21 is a sectional view taken on line D-D in FIG. 15, showing a state where a spacer has been inserted to a final lock position.

A connector (hereinafter referred to as "connector 2") according to a second embodiment of the invention will be described below with reference to FIGS. 19 to 21. The connector 2 is different from the connector 1 at the point that protrusion portions protruding toward the inner housing 200 are added to the spacer 300. Therefore, in the connector 2, parts having the same structures as those in the connector 1 are referenced correspondingly to those in the connector 1. Detailed description of those parts will be omitted befittingly.

Figure 19:
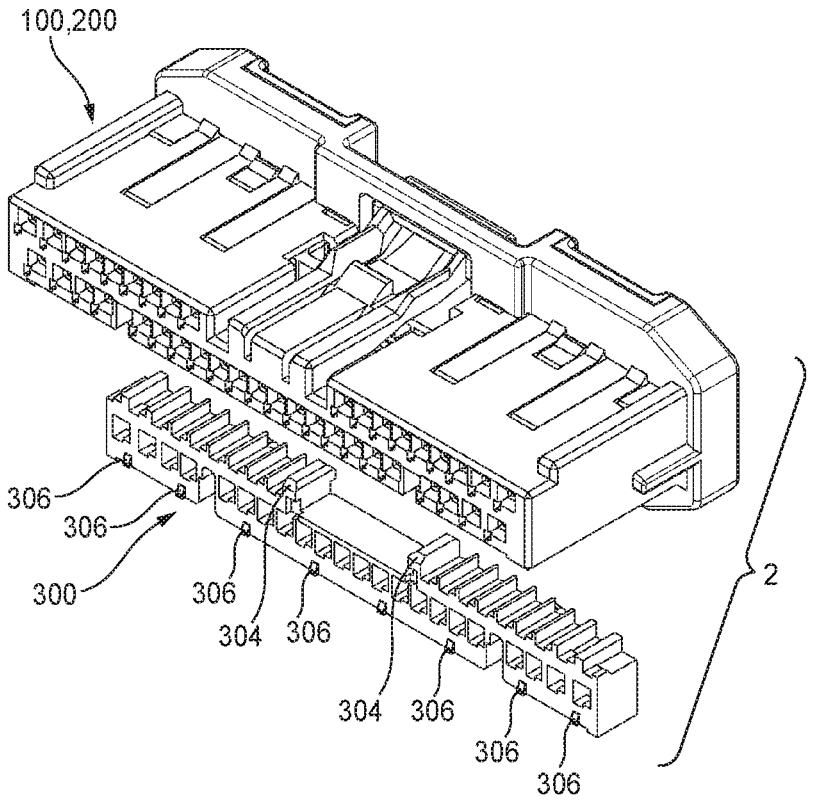
FIG. 19 is an exploded perspective view showing a configuration of a connector according to a second embodiment of the invention.

As shown in FIG. 19, a plurality of protrusion portions 306 are provided on a front surface of a body 302 in the spacer 300 of the connector 2. Each protrusion portion 306 protrudes toward the front wall of the spacer insertion hole 205 of the inner housing 200 as shown in FIG. 20. When the spacer 300 is in the temporary lock position, the protrusion portion 306 abuts against the front wall of the spacer insertion hole 205 of the inner housing 200. Further, when the spacer 300 is in the final lock position, the protrusion portion 306 is fitted (pressure-fitted in this example) to the inner housing 200 as shown in FIG. 21.

Thus, the spacer 300 can be prevented from being unintentionally inserted from the temporary lock position to the final lock position. Specifically, when the elastic modulus of the final lock portions 305 of the spacer 300 is small, the resistance with which the spacer 300 is inserted from the temporary lock position to the final lock position is small. In this case, when the spacer 300 is inserted into the spacer insertion hole 205, it is likely to insert the spacer 300 beyond the temporary lock position to reach the final lock position by mistake. When the spacer 300 is inserted to the final lock position by mistake before terminals of an electric wire end are received in the terminal reception chambers 201, the bottom walls (terminal coming-off preventing wall portions 304) of the third chambers 201C of the spacer 300 may interfere with the terminals to make it difficult to receive the terminals in the terminal reception chambers 201. As a result, it may be necessary to deal with the difficulty, for example, by sending the spacer 300 back to the temporary lock position. Such a problem can be prevented by the protrusion portions 306 belonging to the spacer 300 of the connector 2.

Further, due to the protrusion portions 306, a feeling of moderation (click feeling) can be obtained as soon as the spacer 300 is inserted from the temporary lock position to the final lock position. Specifically, as soon as each protrusion portion 306 moves from the temporary lock position to the final lock position, the state of the protrusion portion 306 is changed over substantially instantly from the state where the protrusion portion 306 abuts against the outer wall surface of the spacer insertion hole 205 to the state where the protrusion portion 306 is pressure-fitted to the front wall of the spacer insertion hole 205. As a result, the feeling of moderation is generated.

As has been described above, due to the protrusion portions 306 provided in the spacer 300, the spacer 300 can be prevented from unintentionally moving to the final lock position. Further, the feeling of moderation can be obtained when the spacer 300 is inserted to the spacer insertion hole 205.

The present invention is not limited to any of the aforementioned embodiments, but various modifications may be made within the scope of the invention.

For example, in the connector 1 and the connector 2 described above, the housing (inner housing 200) defining the terminal reception chambers 201 is attached to the inside of the housing (outer housing 100) defining the mating terminal insertion holes 102. However, a connector according to the invention may have a configuration in which the housing defining the mating terminal insertion holes 102 is inserted to the inside of the housing defining the terminal reception chambers 201.

Here, the features of the aforementioned embodiments of the connectors according to the invention will be summarized and listed briefly in the following items [1] to [3].

[1]

A connector (1 or 2) comprising: a terminal reception chamber (201); and a mating terminal insertion hole (102) to guide a mating terminal into the terminal reception chamber, the terminal reception chamber (201) having:

a first chamber (201A) including an opening (202) on a front side of the terminal reception chamber;

a second chamber (201B) including an opening (203) on a back side of the terminal reception chamber; and a third chamber (201C) placed between the first chamber and the second chamber;

the connector (1) further comprising:

a first housing (100) defining the mating terminal insertion hole (102);

a second housing (200) defining the first chamber (201A) and the second chamber (201B) and being attached to the first housing: and a third housing (300) defining the third chamber (201C) and being attached to the first housing (100) and the second housing (200) to contact with both of the first housing and the second housing and to inseparably connect the first housing and the second housing.

[2]

The connector according to item [1], wherein the second housing (200) has a connection portion (217) connecting a part defining the first chamber (201A) and a part defining the second chamber (201B) to eliminate a relative movement between the first chamber and the second chamber.

[3]

The connector according to item [1] or item [2], wherein the third housing (300) has a protrusion portion (306) protruding toward the second housing; and the protrusion portion (306) contacts with an outer wall surface of the second housing (200) upon the third housing (300) being located in a temporary mounting position where an axis line of the terminal reception chamber (201) has a linear shape, while the protrusion portion (306) fits to the second housing (200) upon the third housing (300) being located in a final mounting position where the axis line of the terminal reception chamber (201) has a curved shape.

REFERENCE SIGNS LIST

1 connector
2 connector
100 outer housing (first housing)
102 mating terminal insertion hole
200 inner housing (second housing)
201 terminal reception chamber
201A first chamber
201B second chamber
201C third chamber
202 opening on front side of terminal reception chamber
203 opening on back side of terminal reception chamber
217 connection portion
300 spacer (third housing)
306 protrusion portion

The invention claimed is:

1. A connector comprising: a terminal reception chamber; and a mating terminal insertion hole to guide a mating terminal into the terminal reception chamber, the terminal reception chamber having:

a first chamber including an opening on a front side of the terminal reception chamber;

a second chamber including an opening on a back side of the terminal reception chamber; and a third chamber placed between the first chamber and the second chamber;

the connector further comprising:

a first housing defining the mating terminal insertion hole;

a second housing defining the first chamber and the second chamber and being attached to the first housing: and a third housing defining the third chamber and being attached to the first housing and the second housing to contact with both of the first housing and the second housing and to inseparably connect the first housing and the second housing.

2. The connector according to claim 1, wherein the second housing has a connection portion connecting a part defining the first chamber and a part defining the second chamber to eliminate a relative movement between the first chamber and the second chamber.

3. The connector according to claim 1, wherein the third housing has a protrusion portion protruding toward the second housing: and the protrusion portion contacts with an outer wall surface of the second housing upon the third housing being located in a temporary mounting position where an axis line of the terminal reception chamber has a linear shape, while the protrusion portion fits to the second housing upon the third housing being located in a final mounting position where the axis line of the terminal reception chamber has a curved shape.

* * * * *